US009022105B2

(12) United States Patent
Corre et al.

(10) Patent No.: US 9,022,105 B2
(45) Date of Patent: May 5, 2015

(54) EXPANDABLE FILTERING SYSTEM FOR SINGLE PACKER SYSTEMS

(75) Inventors: Pierre-Yves Corre, Eu (FR); Stephane Metayer, Abbeville (FR); Alexander F. Zazovsky, Houston, TX (US); Stephen Yeldell, Sugar Land, TX (US); Jean-Louis Pessin, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 14/127,765

(22) PCT Filed: Jun. 25, 2012

(86) PCT No.: PCT/US2012/044081

§ 371 (c)(1),
(2), (4) Date: Feb. 18, 2014

(87) PCT Pub. No.: WO2012/178203

PCT Pub. Date: Dec. 27, 2012

(65) Prior Publication Data

US 2014/0151039 A1 Jun. 5, 2014

Related U.S. Application Data

(60) Provisional application No. 61/500,959, filed on Jun. 24, 2011.

(51) Int. Cl.
*E21B 33/127* (2006.01)
*E21B 49/10* (2006.01)
(Continued)

(52) U.S. Cl.
CPC ..... *E21B 49/10* (2013.01); *E21B 33/1277* (2013.01); *E21B 49/08* (2013.01); *E21B 33/12* (2013.01); *E21B 43/08* (2013.01); *E21B 43/10* (2013.01)

(58) Field of Classification Search
CPC ..... E21B 33/127; E21B 33/1272; E21B 33/1275; E21B 33/1277; E21B 33/1243; E21B 33/1246
USPC ..... 166/100, 227, 229, 187
See application file for complete search history.

(56) References Cited

U.S. PATENT DOCUMENTS 2,843,208 A 7/1958 Blood
6,174,001 B1 1/2001 Enderle
(Continued)

FOREIGN PATENT DOCUMENTS

WO WO 2009001073 A2 * 12/2008

OTHER PUBLICATIONS

International Search Report for PCT Application Serial No. PCT/US2012/044081, dated Jan. 14, 2013.
(Continued)

*Primary Examiner* — Giovanna Wright
(74) *Attorney, Agent, or Firm* — Kenneth L. Kincaid; Cathy Hewitt

(57) ABSTRACT

An arrangement having a body with at least one drain provided in the body is disclosed. The drain is configured to receive fluid when the body is expanded from a first unexpanded condition to a second expanded condition. At least one flowline is connectable to the drain. A screen is positioned over the drain and is configurable to expand from the first unexpanded condition to the second expanded condition.

20 Claims, 9 Drawing Sheets

(51) Int. Cl.

| | |
|---|---|
| ***E21B 49/08*** | (2006.01) |
| ***E21B 33/12*** | (2006.01) |
| ***E21B 43/08*** | (2006.01) |
| ***E21B 43/10*** | (2006.01) |

(56) References Cited

U.S. PATENT DOCUMENTS

| | | | | |
|---|---|---|---|---|
| 7,814,973 | B2 * | 10/2010 | Dusterhoft et al. | 166/227 |
| 8,479,810 | B2 * | 7/2013 | Metcalfe | 166/227 |
| 2003/0173075 | A1 * | 9/2003 | Morvant et al. | 166/230 |
| 2007/0215348 | A1 | 9/2007 | Corre et al. | |
| 2010/0051270 | A1 * | 3/2010 | Dusterhoft et al. | 166/278 |
| 2010/0071898 | A1 * | 3/2010 | Corre et al. | 166/264 |
| 2011/0067860 | A1 | 3/2011 | Corre et al. | |

OTHER PUBLICATIONS

Bunn, et al. "Design, Implementation, and Interpretation of a Three-Dimensional Well Test in the Cormorant Field, North Sea," SPE 15858, Oct. 1986, 10 pages.

Kaneda, et al. "Interpretation of a Pulse Test in a Layered Reservoir," SPE 21337, Dec. 1991, pp. 453-462.

Lasseter, et al. "Interpreting an RFT-Measured Pulse Test with a Three-Dimensional Simulator," SPE 14878, SPE Formation Evaluation, Mar. 1988, pp. 139-146.

Saeedi, et al. "Layer Pulse Testing Using a Wireline Formation Tester," SPE 16803, Sep. 1987, pp. 543-550.

Yaxley, et al. "A Field Example of Interference Testing Across a Partially Communicating Fault," SPE 19306, 1989, 41 pages.

Bunn, et al. "Distributed Pressure Measurements Allow Early Quantification of Reservoir Dynamics in the Jene Field," SPE 17682, Mar. 1991.

* cited by examiner

EXPANDABLE FILTERING SYSTEM FOR SINGLE PACKER SYSTEMS

RELATED APPLICATION

This application claims the benefit from U.S. Provisional Patent Application No. 61/500,959, filed on Jun. 24, 2011, entitled "Expandable Filtering System for Single Packer Systems," which is hereby incorporated by reference in its entirety.

BACKGROUND OF THE DISCLOSURE

While the disclosure is applicable outside the oil field industry, one such use of the disclosure is in sampling underground reservoir fluids. Sampling of underground fluids is typically beneficial in identifying underground fluid constituents and properties related thereto. For example, fluid sampling may be conducted by deploying a probe having a sampling port to receive formation fluid. The identification of fluid properties is beneficial for understanding the reservoir, planning extraction and production techniques, and even providing information on expected refinement requirements.

A wellbore is generally drilled prior to sampling the underground formation fluids. The probe is limited to providing a single fluid sample at a given depth and radial location of the wellbore. The probe must then be moved to a subsequent location in order to sample fluid at a different depth. The probe is extended from a tool and pressed against the wellbore formation to receive fluid. The fluid may be tested downhole or trapped and later tested at the surface.

Conventional sampling systems, such as the probe, not only receive formation fluid but also unwanted filtrate or contaminates. In many instances, the filtrate or contaminants may be large enough to clog a port of the sampling system. The clogging can prevent any further fluid from being received through the sampling port. Solutions to this have focused on methods to continue sampling rather than any solution related preventing the debris from invading the sampling port. Chief among these techniques is to increase the drawdown pressure at the sampling port with an underground pump. As can be expected, however, such a solution can cause additional dislodgement of particles, preventing further sampling.

Dealing with a clogged sampling port can cause additional rig time, which can be expensive, or even a failure to receive fluid samples, which can lead to inaccurate fluid property measurements, fluid models or other undesirable outcomes that are attempting to be prevented by the sampling operation. Improvements in sampling systems are beneficial in the industry to save expensive rig time and ensure quality formation sample measurements are obtained.

DETAILED DESCRIPTION

Figure 1:
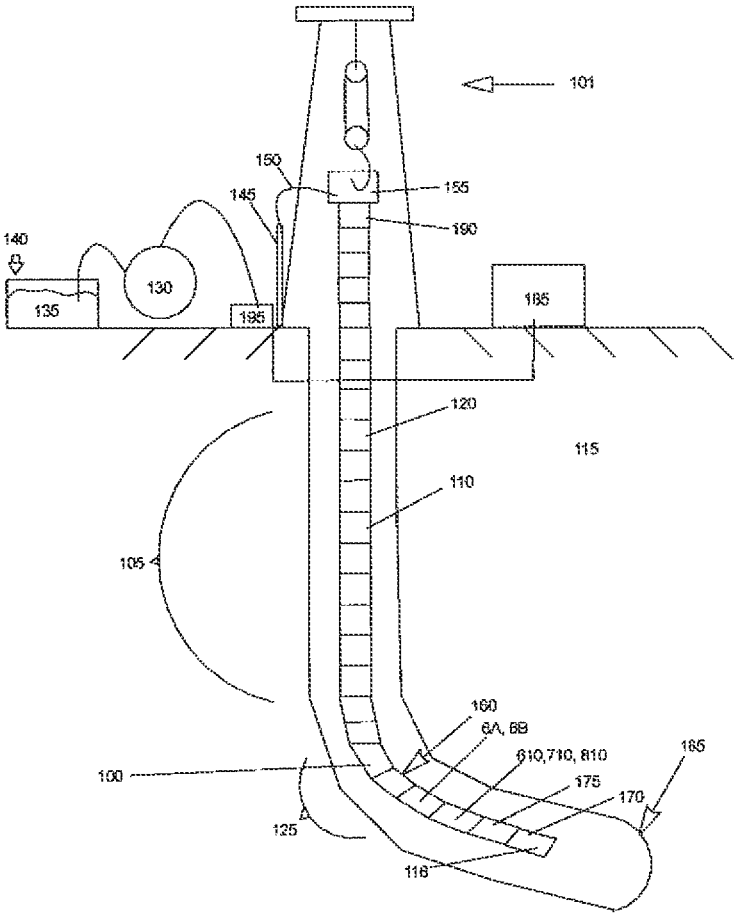
FIG. 1 is a side elevational view of a drilling rig in conformance with an example embodiment of drilling operations performed.

It will be understood that the following disclosure provides many different embodiments, or examples, for implementing different features of various embodiments. Specific examples of components and arrangements are described below to simplify the present disclosure. These are, of course, merely examples and are not intended to be limiting. In addition, this disclosure may repeat reference numerals and/or letters in the various examples. This repetition is for the purpose of simplicity and clarity and does not itself dictate a relationship between the various embodiments and/or configurations discussed. Moreover, the subterranean formation of a first feature over or on a second feature in the description may include embodiments in which the first and second features are formed in direct contact, and may also include embodiments in which additional features may be formed interposing the first and second features, such that the first and second features may not be in direct contact.

In accordance with the present disclosure, a wellsite with associated wellbore and apparatus is described in order to describe an embodiment of the disclosure, but not limiting or only arrangement of the subject matter of the disclosure. To that end, apparatus at the wellsite may be altered, as necessary, due to field considerations encountered.

The present disclosure illustrates a system and method for collecting formation fluid through a port or drain in the body of an inflatable or expandable packer. The collected formation fluid may be conveyed along an outer layer of the packer to a tool flow line and then directed to a desired collection location. Use of the packer to collect a sample enables the use of larger expansion ratios and higher drawdown pressure differentials. Additionally, because the packer uses a single expandable sealing element, the packer is better able to support the formation in a produced zone at which formation fluids are collected. This quality facilitates relatively large amplitude draw-downs even in weak, unconsolidated formations.

The packer is expandable across an expansion zone to collect formation fluids from a position along the expansion zone, i.e. between axial ends of the outer sealing layer. Formation fluid can be collected through one or more ports or drains comprising fluid openings in the packer for receiving formation fluid into an interior of the packer. The ports may be positioned at different radial and longitudinal distances. For example, separate ports can be disposed along the length of the packer to establish collection intervals or zones that enable focused sampling at a plurality of collecting intervals, e.g. two or three collecting intervals. The formation fluid collected may be directed along flow lines, e.g. along flow tubes, having sufficient inner diameter to transport the formation fluid. Separate flowlines can be connected to different drains to enable the collection of unique formation fluid samples. In other applications, sampling can be conducted by using a single drain placed between axial ends of the packer sealing element.

Referring generally to FIG. 1, one embodiment of a well system 101 is illustrated as deployed in a wellbore 110. The well system 101 comprises a conveyance 105 employed to deliver at least one packer 160 into the wellbore 110. In many applications, the packer 160 is used on a modular dynamics formation tester (MDT) tool deployed by the conveyance 105 in the form of a wireline. However, the conveyance 105 may have other forms, including tubing strings, such a coiled tubing, drill strings, production tubing, casing or other types of conveyance depending on the required application. In the embodiment illustrated, the packer 160 is an inflatable or extendable packer used to collect formation fluids from a surrounding formation 115. The packer 160 is selectively expanded in a radially outward direction to seal across an expansion zone. For example, the packer 160 may be inflated by fluid, such as wellbore fluid, hydraulic fluid or other fluid. When the packer 160 is expanded to seal against the wellbore 110, formation fluids can flow into the packer 160. The formation fluids may then directed to a tool flow line and produced to a collection location, such as a location at a well site surface.

As shown in FIG. 1, the conveyance 105 may extend from a rig 101 into a zone of the formation 115. In an embodiment, the packer 160 may be part of a plurality of tools 125, such as a plurality of tools forming a modular dynamics formation tester. The tools 125 may collect the formation fluid, test properties of the formation fluid, obtain measurements of the wellbore, formation about the wellbore or the conveyance 105, or perform other operations as will be appreciated by those having ordinary skill in the art. The tools 125 may be measurement while drilling or logging while drilling tools, for example such as shown by numerals 6*a* and 6*b*. In an embodiment, the downhole tools 6*a* and 6*b* may be a formation pressure while drilling tool.

In an embodiment, the tools 125 may include logging while drilling ("LWD") tools having a thick walled housing, commonly referred to as a drill collar, and may include one or more of a number of logging devices. The logging while drilling tool may be capable of measuring, processing, and/or storing information therein, as well as communicating with equipment disposed at the surface of the well site. As another example, the tools 125 include measurement while drilling ("MWD") tools may include one or more of the following measuring tools a modulator, a weight on bit measuring device, a torque measuring device, a vibration measuring device, a shock measuring device, a stick slip measuring device, a direction measuring device, and inclination measuring device, and\or any other device. As yet another example, the tools 125 may include a formation capture device 170, a gamma ray measurement device 175 and a formation fluid sampling tool 610, 710, 810 which may include a formation pressure measurement device 6*a* and/or 6*b*. The signals may be transmitted toward the surface of the earth along the conveyance 105.

Measurements obtained or collected may be transmitted via a telemetry system to a computing system 185 for analysis. The telemetry system may include wireline telemetry, wired drill pipe telemetry, mud pulse telemetry, fiber optic telemetry, acoustic telemetry, electromagnetic telemetry or any other form of telemetering data from a first location to a second location. The computing system 185 is configurable to store or access a plurality of models, such as a reservoir model, a fluid analysis model, a fluid analysis mapping function.

The rig 101 or similar looking/functioning device may be used to move the conveyance 105. Several of the components disposed proximate to the rig 101 may be used to operate components of the overall system. For example, a drill bit 116 may be used to increase the length (depth) of the wellbore. In an embodiment where the conveyance 105 is a wireline, the drill bit 116 may not be present or may be replaced by another tool. A pump 130 may be used to lifts drilling fluid (mud) 135 from a tank 140 or pits and discharges the mud 135 under pressure through a standpipe 145 and flexible conduit 150 or hose, through a top drive 155 and into an interior passage inside the conveyance 105. The mud 135 which can be water or oil-based, exits the conveyance 105 through courses or nozzles (not shown separately) in the drill bit 116, wherein it cools and lubricates the drill bit 116 and lifts drill cuttings generated by the drill bit 116 to the surface of the earth through an annular arrangement.

When the well 110 has been drilled to a selected depth, the tools 125 may be positioned at the lower end of the conveyance 105 if not previously installed. The tools 125 may be coupled to an adapter sub 160 at the end of the conveyance 105 and may be moved through, for example in the illustrated embodiment, a highly inclined portion 165 of the well 110.

During well logging operations, the pump 130 may be operated to provide fluid flow to operate one or more turbines in the tools 125 to provide power to operate certain devices in the tools 125. When tripping in or out of the well 110, (turning on and off the mud pumps 130) it may be in feasible to provide fluid flow. As a result, power may be provided to the tools 125 in other ways. For example, batteries may be used to provide power to the tools 125. In one embodiment, the batteries may be rechargeable batteries and may be recharged by turbines during fluid flow. The batteries may be positioned within the housing of one or more of the tools 125. Other manners of powering the tools 125 may be used including, but not limited to, one-time power use batteries.

An apparatus and system for communicating from the conveyance 105 to the surface computer 185 or other component configured to receive, analyze, and/or transmit data may include a second adapter sub 190 that may be coupled between an end of the conveyance 105 and the top drive 155 that may be used to provide a communication channel with a receiving unit 195 for signals received from the tools 125. The receiving unit 195 may be coupled to the surface computer 185 to provide a data path therebetween that may be a bidirectional data path.

Though not shown, the conveyance 105 may alternatively be connected to a rotary table, via a Kelly, and may suspend from a traveling block or hook, and additionally a rotary swivel. The rotary swivel may be suspended from the drilling rig 101 through the hook, and the Kelly may be connected to the rotary swivel such that the Kelly may rotate with respect to the rotary swivel. The Kelly may be any mast that has a set of polygonal connections or splines on the outer surface type that mate to a Kelly bushing such that actuation of the rotary table may rotate the Kelly. An upper end of the conveyance 105 may be connected to the Kelly, such as by threadingly reconnecting the drill string 105 to the Kelly, and the rotary table may rotate the Kelly, thereby rotating the drill string 105 connected thereto.

Figure 2:
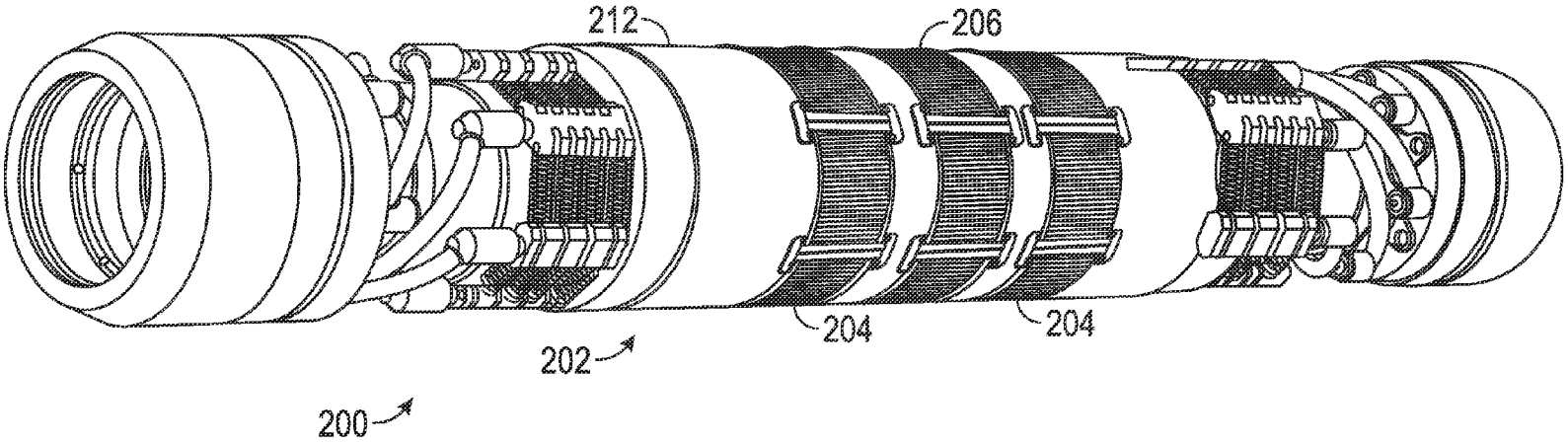
FIG. 2 is a perspective view of a packer system in conformance with an example embodiment of an aspect described.

FIG. 2 illustrates an embodiment of a packer system 200. For example, the packer system 200 may be the packer 160 as shown in FIG. 1 or may be deployed into a wellbore for other uses. The packer system 200 may be described as a "packer"

for brevity in some circumstances. The packer system 200 may be used to fluidly isolate one portion of a wellbore from another portion of a wellbore. The packer system 200 is conveyed to a desired downhole location and, in the non-limiting embodiment provided, inflated or expanded to provide a seal between the packer system 200 and the well 110. For example, the packer system may prevent fluid communication from two portions of a wellbore by expanding or inflating circumferentially to abut the wellbore.

The packer system 200 may have one or more ports or sampling drains 204, 206 for receiving fluid from the formation or the wellbore into the packer system 200. In an embodiment, the packer system 200 has one or more guard ports 204 located longitudinally from one or more sample ports 206. In the illustrated embodiment, the guard ports 204 are illustrated a closer longitudinal distance from ends of the packer system than a longitudinal distance of the one or more sample ports 206 to the ends of the packer system 200. The ports 204, 206 may be located at distinct radial positions about the packer system 200 such that the ports 204, 206 contact different radial positions of the wellbore. The ports 204, 206 may be embedded radially into a sealing element of outer layer of the packer system 200. By way of example, sealing element may be cylindrical and formed of an elastomeric material selected for hydrocarbon based applications, such as nitrile rubber (NBR), hydrogenated nitrile butadiene rubber (HNBR), and fluorocarbon rubber (FKM). The packer system 200 may be expanded or inflated, such as by the use of wellbore fluid, hydraulic fluid, mechanical means or otherwise positioned such that the one or more sample ports 206 and the one or more guard ports 204 may abut the walls of the formation 115 to be sampled. The packer system 200 may be expanded or inflated from a first position to a second position such that the outer diameter of the packer system 200 is greater at the second position than the first position. In an embodiment, the second position may be the position in which the ports 204, 206 abut the formation and the first position may be an unexpanded or deflated position. The packer system 200 may move to a plurality of positions between the first position and the second position. The packer system 200 may expand in the relative areas around the one or more guard ports 204 and the one or more sample ports 206 such that a tight seal is achieved between the exterior of the packer system 200 and wellbore, casing pipe or other substance external to the packer system 200.

Operationally, the packer system 200 is positioned within the wellbore 110 to a sampling location. The packer system 200 is inflated or expanded to the formation through the expansion of the body 202 of the packer system 200 expanding with the internal diameter of the pipe or within the formation 115. A pump may be utilized to draw fluid from the ports 204, 206 and/or to transport fluid within or out of the packer system 200. The pump may be incorporated into the packer system 200 or may be external to the packer system 200. The fluid removed through the sample drain 206 and/or guard drains 204 may then be transported through the packer system 200 to a downhole tool, such as the tools 125 for example. In an alternative configuration, the packer system 200 may retain the fluid in an interior system for later analysis when the packer system 200 is deflated or unexpanded and retrieved. An outer seal layer 212 is provided around the periphery of the remainder of the packer system 200 to allow for mechanical wear of the unit as well as sealing capability to the formation 115 or inner wall of the wellbore. The packer system 200 may have an inner, inflatable bladder disposed within an interior of outer seal layer 212.

Figure 3:
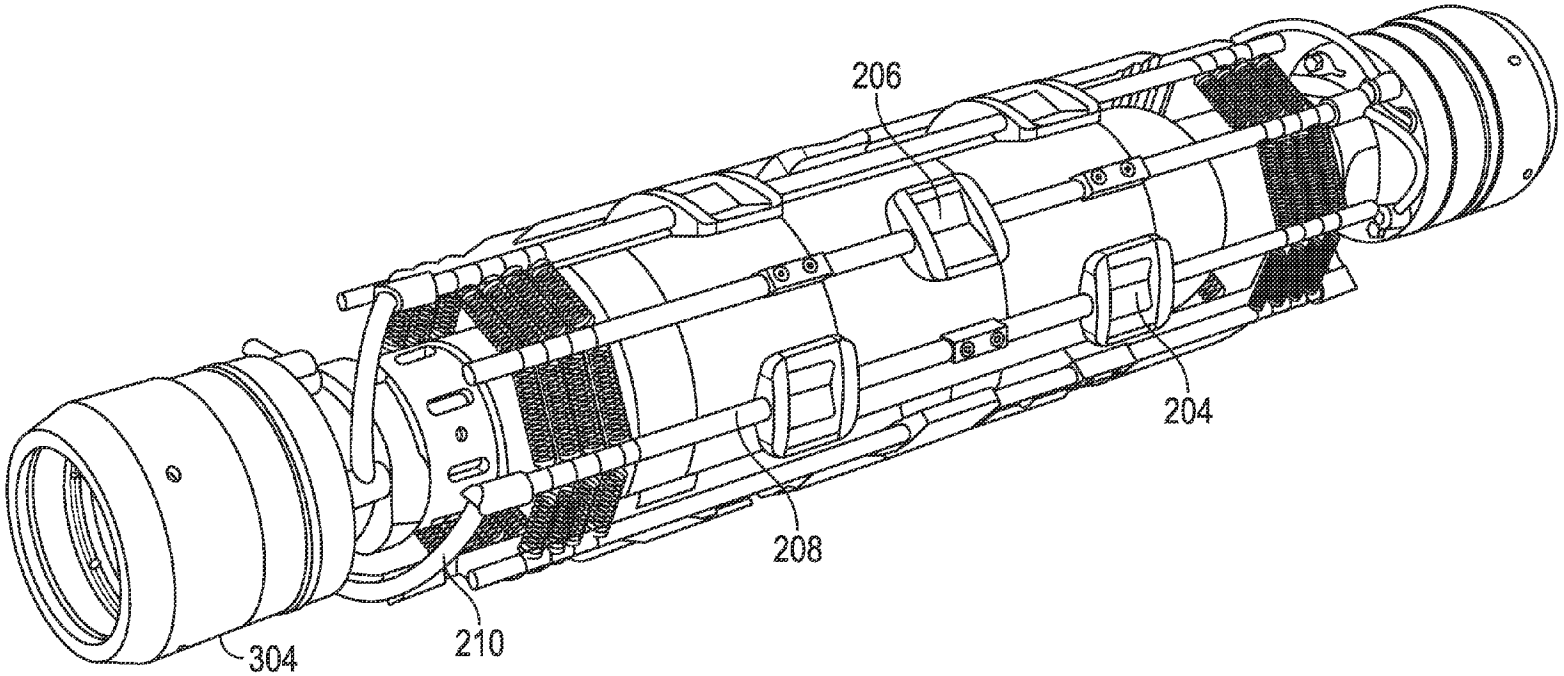
FIG. 3 is a perspective view of the packer system of FIG. 2 with an outer seal covering removed for viewing of the internal components.

Referring to FIG. 3, the packer system 200 is illustrated without the outer seal layer 212. The guard ports 204 are positioned a longitudinal distance from the sample ports 206 and at different longitudinal distances from the relative outside positions/ends of the sample ports 206. One or more flow lines 208 are in fluid communication with one or more of the guard ports 204 and/or the sample ports 206. For example, one of the flow lines 208 may be connected to two of the guard ports 204, and another one of the flow lines 208 may be connected only to one of the sample ports 206. The flow lines 208 may be connected to a rotating tube 210 that allows for radial expansion of the packer system 200 without damaging the flow lines 208. The rotating tubes 210 permit the flow lines 208 to be embedded within the packer system, such as embedded within the outer seal layer 212 and/or positioned along a longitudinal axis of the packer system 200. For example, the rotating tubes 210 permit radial expansion of the packer system while permitting the flow lines 208 to maintain a longitudinal position with respect to the packer system 200.

Figure 4:
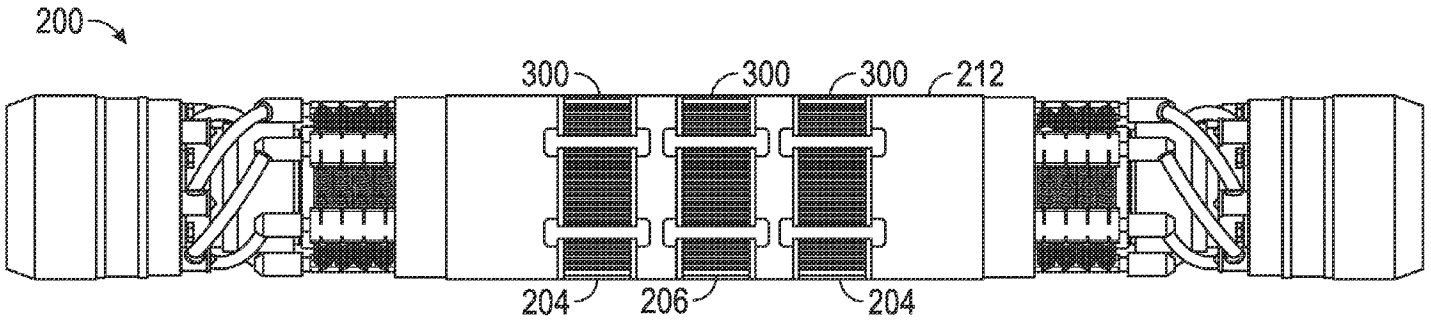
FIG. 4 is a side elevational view of the packer system of FIG. 2.

The initiation of flow through the one or more guard ports 204 and the one or more sample ports 206 may dislodge debris from the wellbore 110 and/or the formation 115. Referring to FIG. 4, the packer system 200 is illustrated in side elevational view. As illustrated, one or more filters 200 are positionable about the guard ports 204 and/or the sample ports 206 to prevent debris from passing therethrough. The filters 300 are removable and may be replaceable based on a size of the debris. In the illustrated embodiment, the filters 300 abut the outer seal layer 212 to prevent materials from entering the packer drain systems without traveling through the screens 300. The filters 300 may be located in grooves in the outer seal layer 212.

Figure 5:
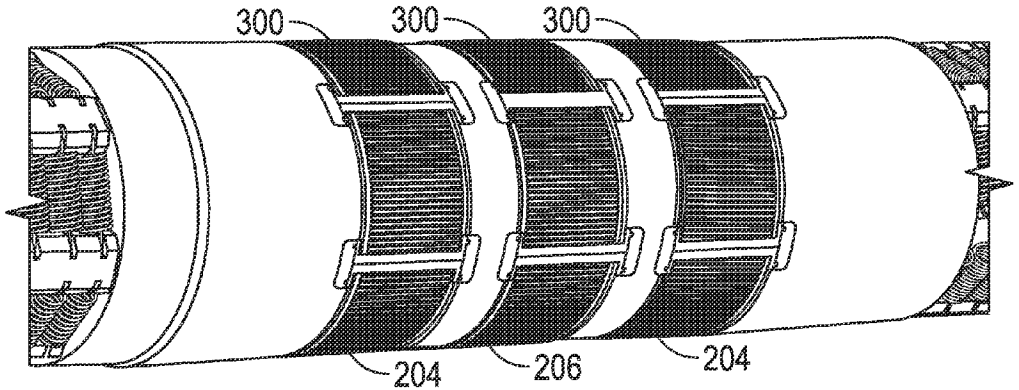
FIG. 5 is a close-up perspective view of the expandable screens of FIG. 3.

Referring to FIG. 5, an exploded view of the screens 300 of the guard ports 204 and sample ports 206 is provided. In the illustrated embodiment, nine individual filters 300 are positioned around the periphery section illustrated, for approximately 180 degrees of the entire circumference of the packer system 200. In an embodiment, the guard ports 204 and the sample ports 206 may have, for example, eighteen (18) total screen sections.

Figure 6:
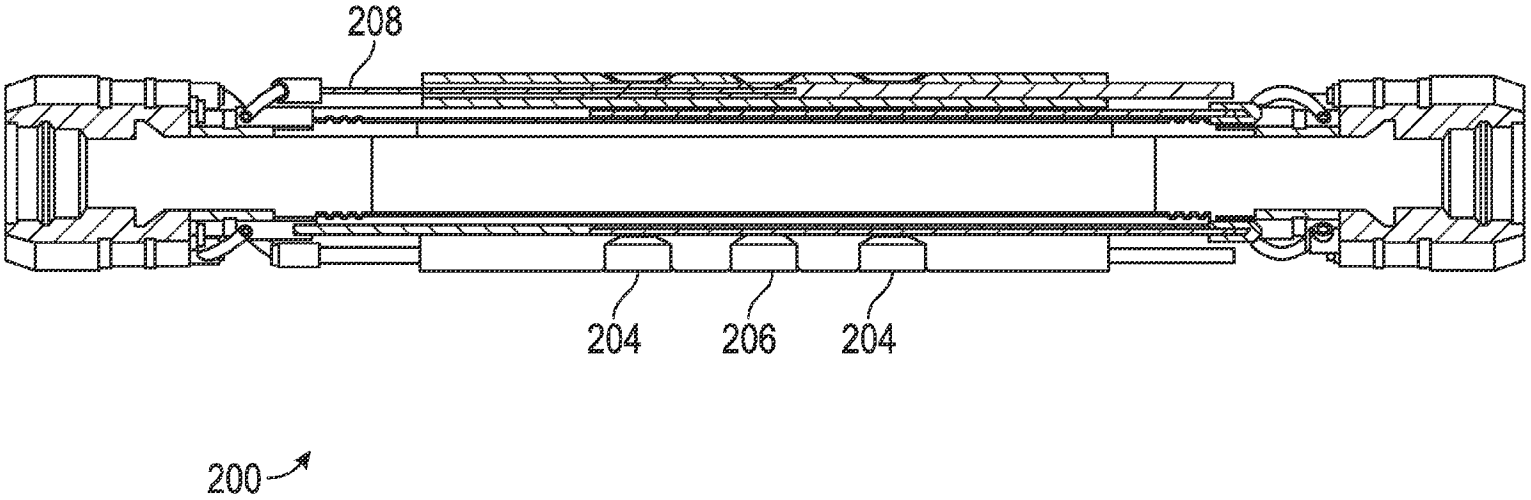
FIG. 6 is a sectional view of the packer system of the expandable screens and underlying components of FIG. 5.

Referring to FIG. 6, a cross-section of the guard ports 204 and the sample ports 206 is illustrated. The flow lines 208 are provided below the screens 300 on the guard ports 204 and sample ports 206 to convey the fluid that enters the respective ports 204, 206. In the illustrated embodiment, fluid flow from the guard ports 204 is conveyed separately from fluid flow from the sample ports 206.

Figure 7:
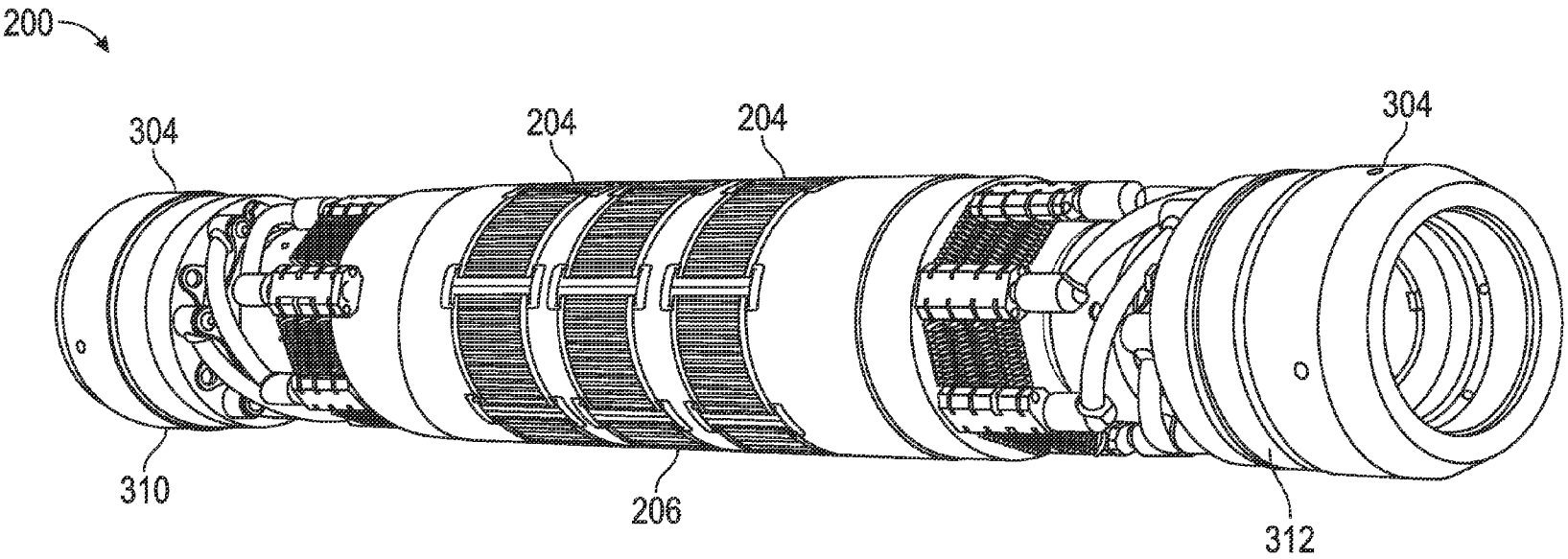
FIG. 7 is a perspective view of the packer system of FIG. 2, illustrating the connectors for the packer system.

Referring to FIG. 7, a perspective view of the packer system 200 of FIG. 2, illustrating the connectors 304 is presented. The connectors 304 are used to connect the packer system 200 to the remainder of underground equipment, such as underground testing equipment or flow control devices. The connectors 304 are configured to separately convey fluids from the guard ports 204 and the sample ports 206. In the illustrated embodiment, the flow from the guard ports 204 flow to one end 310 of the packer system 200, while flow from the sample ports 206 flow to the other respective end 312 of the packer system 200.

Figure 8:
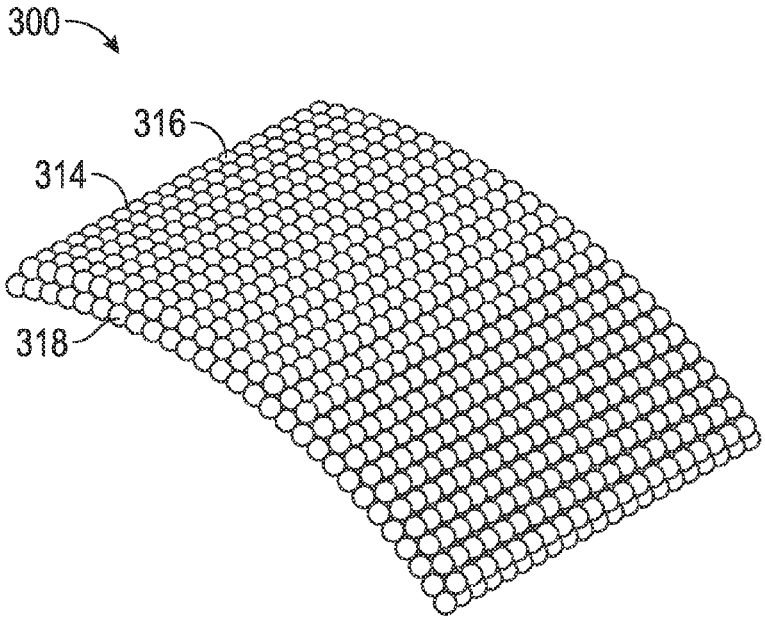
FIG. 8 is a perspective view of a screen of the packer system of FIG. 2 before expansion.

Referring to FIG. 8, a perspective view of the filter 300 of the packer system 200 of FIG. 2 before expansion is illustrated. The filter 300 comprises a non-compressible expandable material. In the illustrated example embodiment, the material comprises a ball or bead material 316 arranged such that spaces are formed between the material 316. The spacing between each of the beads or balls allows fluid from the formation 115 to flow through while preventing larger material such as debris. In the illustrated embodiment, the material 316 may be metallic, such as stainless steel. The material 316 may be other materials depending on the environment, such as plastic. The material 316 may comprise other materials, such as a mechanical spring configuration, whereby the overall configuration provides filtering between coils of the spring after expansion. As another example, the material 316 may comprise a metallic braid configuration, the metallic braid is configured from metallic wires woven or braided together to form the matrix. In either configuration, mechanical spring or metallic braid, the filter 300 is configured to expand from a first deflated/unexpanded condition to a second inflated/expanded condition.

In an embodiment, the filters 300 are positioned in replaceable sections about the seal layer 212 of the packer 200. Thus, the seal layer 212 may expand as well as the filter 300, upon actuation, permitting the seal layer 212 to remain impervious to fluid intrusion, while the filter 300 allows flow through the expanded surface. For example, the filter 300 may increase in size, such as length or diameter, to substantially cover the respective guard port 204 or sample port 206. The filter 300 may comprise a first section 314 and a second section 318. The first section 314 may be movable with respect to the second section 318. As the filter 300 increases in size, for example, the first section 314 and/or the second section 318 may move with respect to the other section. As an example, in the first position of the packer system 200 the first section 314 of the filter 300 may overlap the second section 318 of the filter 300. As the packer system 200 moves form the first position to the second position, the first section 314 or the second section 318 may move such that the size of the filter 300 increases. As illustrated in FIG. 8, for example, the second portion 318 is at least partially underneath the first portion 316. As the packer system 200 expands, the second portion 318 will be exposed to increase the size of the filter 300.

Figure 9:
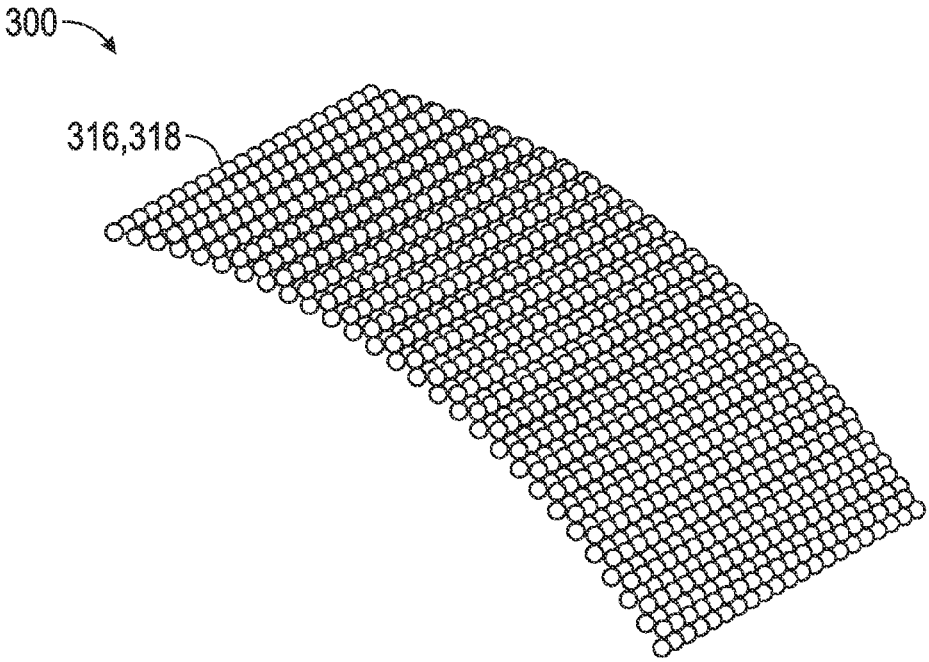
FIG. 9 is a perspective view of a screen of the packer system of FIG. 2 after expansion.

Referring to FIG. 9, the filter 300 of FIG. 8 is illustrated in an expanded screen position. As provided, the ball material of the example embodiment allows for filtering of the fluid in the expanded condition of the packer 200 assembly. As there are two levels of ball material in the screen 300, the screen 300 can approximately double in size, allowing the packer 200 to significantly expand. In the illustrated embodiment, the ball material expands to an essentially single layer from the two portions 316, 318 in FIG. 8.

Figure 10:
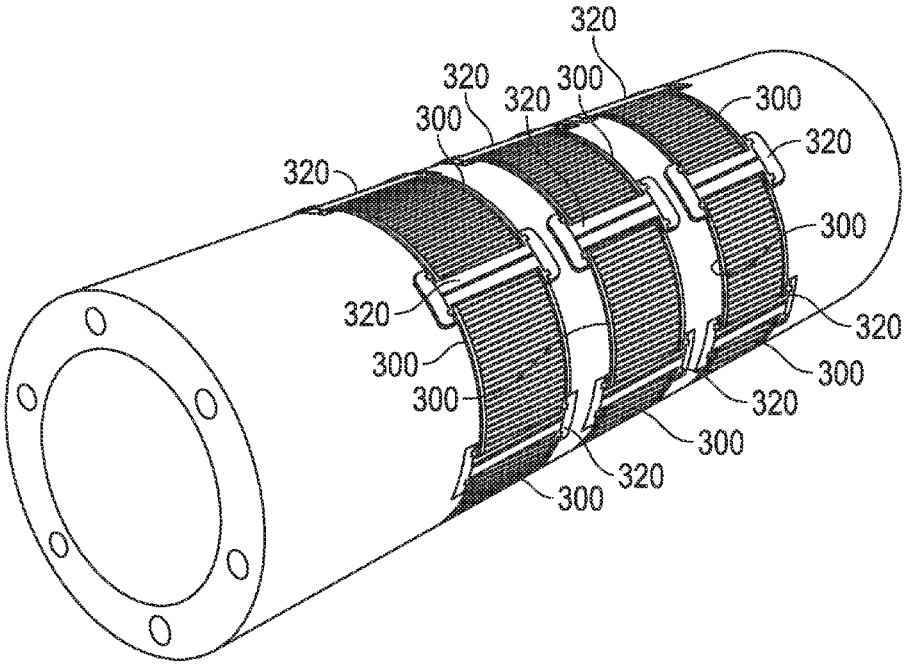
FIG. 10 is a perspective view of the seal layer and screens of the packer system of FIG. 2, illustrating 18 individual sections.

Referring to FIG. 10, the filters 300 of FIG. 9 are installed around the periphery of the packer system 200 such that the filters 300 fit the tubular shape. In the illustrated embodiment, there are eighteen of the filters 300 installed on the outside periphery. The filters 300 may contact or secure to connectors 320 that may be utilized to secure the filters 300 to the outer seal layer 212 and/or to each other. The number of filters 300 to be installed in the packer system 200 may be determined by dividing the entire circumference of 360 degrees by the number of units desired. In this manner, a greater or lesser number of screens around the periphery may be used. In the illustrated embodiment, each of the filters 300 represents a 60 degree radius.

Figure 11:
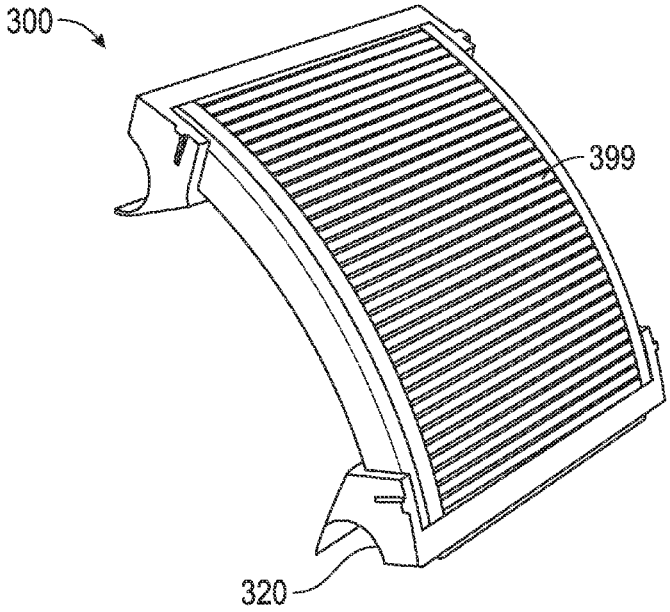
FIG. 11 is a perspective view of a single section of screen in an installment position of FIG. 10.

Referring to FIG. 11, the filter 300 and associated one of the connectors 320 is illustrated in peripheral view. The filter 300 comprises the material 316 in substantially or completely enclosed or encapsulated by material 399. The material 399, in an embodiment, may comprise an anti-extrusion material, such as fibers, for example Kevlar fibers, carbon fibers or the anti-extrusive fibers. The material 399 may be expandable as the packer system 300 expands from the first position to the second position.

Figure 12:
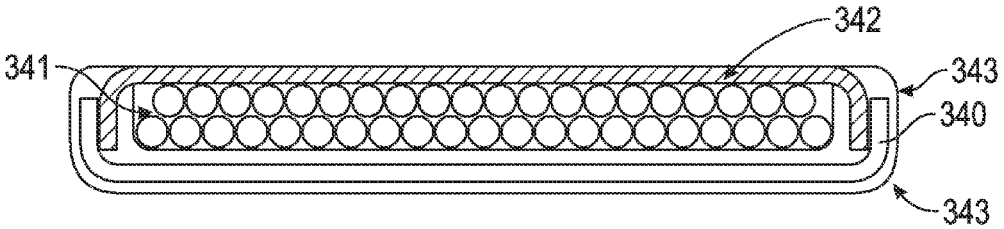
FIG. 12 is a sectional view of the screen section of FIG. 11.

Referring to FIG. 12, the filter 300 of FIG. 11 is illustrated in cross-section. In the illustrated embodiment, two levels of bead material 341 are illustrated over an anti-extrusion fiber backing 340. A fiber cap 342 is placed over the layers of bead material 341 to allow the bead materials to slide overtop of one another, while remaining within the respective filter 300. The fiber cap 342 is constructed to allow for providing a restraining pressure on the ball material so that the restraining pressure is directed toward the central axis of the packer 200. In an embodiment the fiber cap 342 may comprise a plurality of rod like devices placed side by side, such as metallic rods. The filter 300 may be provided with rounded corners 343 to prevent damage to other like units.

Figure 13:
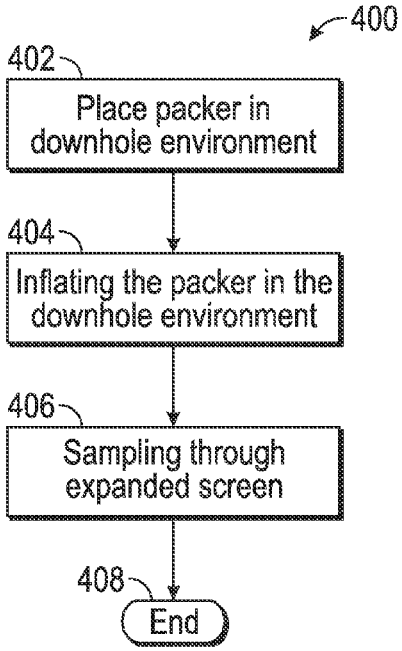
FIG. 13 is a method of sampling fluid from an underground formation.

Referring to FIG. 13, a method for sampling is illustrated. In this method 400, steps may include placing a packer 200 in a downhole environment as shown at step 402. The method 400 may then proceed to the step of inflating or expanding the packer system 200 in the downhole environment so that an exterior surface of the packer system 200 contacts an interior diameter of the downhole environment, wherein during the expanding, a filter at least partially covering a fluid port 204, 206 in the packer expands from a first unexpanded position to a second expanded position as shown at step 404. The method then entails sampling the fluid through the filter 300 as shown at step 406. The method may then end at step 408.

As will be understood, sampling the fluid through the filter 300 is performed by drawing fluid into the port 204, 206. In an embodiment, vacuum from a pump may be used to draw formation fluid from a geotechnical formation through the port 204, 206. Additionally, sampling the fluid may entail drawing the fluid through both a guard drain 204 and the sample drain 206 of the packer system 200. The method 400 may also include the step of transporting at least one of the fluids from the guard drain 204 and the sample drain 206 of the packer 200 to a remote location 408. The arrangements described may be placed in the downhole environment through, for example, a drill string, a wireline or other method. Different conveyance may be used for the packer system 200, including slickline, conventional wireline, logging while fishing systems, coiled tubing and tractor systems in addition to that described above.

In one embodiment, a system is disclosed. In this arrangement a body with at least one drain provided in the body, the drain configured to accept a fluid, the body configured to expand from a first unexpanded condition to a second expanded condition at least one tube connected to the at least one drain and at least one screen disposed over each of the at least one drain, the screen configured to expand from the first unexpanded condition to the second expanded condition are described.

In another embodiment, the system may be configured wherein the at least one filter disposed over the at least one drain is configured to expand from the first unexpanded condition to the second expanded condition by a first part of the at least one filter sliding upon a second part of the filter.

The foregoing outlines feature of several embodiments so that those skilled in the art may better understand the aspects of the disclosure. Those skilled in the art should appreciate that they may readily use the present disclosure as a basis for designing or modifying other processes and structure for carrying out the sample purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A system comprising:

a body having a plurality of fluid ports positioned radially about the body, the body expandable or inflatable from a first position to a second position such that a diameter of the body at the first position is less than a diameter of the body at the second position, wherein at least one of the plurality of fluid ports is positioned a radial distance from another one of the plurality of fluid ports;

a filter positioned about at least one of the plurality of fluid ports to prevent debris from passing into the fluid port, wherein the filter comprises a first level of filter material configured to increase in surface area from the first position to the second position and a second level of filter material configured to increase in surface area from the first position to the second position.

2. The system according to claim 1, wherein the filter is configured to expand in length or diameter from the first position to the second position.

3. The system according to claim 2 wherein the filter expands at least in part by the first level of filter material moving with respect to the second level of filter material.

4. The system according to claim 3, wherein the filter is located in a groove in an outer layer of the body.

5. The system according to claim 1 wherein the filter material comprises a ball shaped material having gaps between the material sized to receive the fluid and prevent the debris.

6. The system according to claim 1, wherein the filter is covered by an expandable material.

7. The system according to claim 6, wherein the filter is connected to an outer seal layer of the body.

8. The system according to claim 1, further comprising:

a base supporting the filter, wherein the base comprises anti-extrusion fibers.

9. The system according to claim 1, wherein the plurality of ports comprise at least a first port and a second port and further wherein the first port is positioned a radial and longitudinal distance from the second port and further wherein the filter is positioned about the first port and a second filter is positioned about the second port.

10. The system according to claim 9, further comprising a first flow line in the body fluidly connected to a first port and a second flow line in the body fluidly connected to the second port.

11. A system comprising:

an inflatable packer movable between a first position and a second position, the packer having a greater diameter at the second position than at the first position;

a first port in the packer providing fluid communication from an exterior of the packer to an interior of the packer;

a filter at least partially covering an exterior surface of the first port, wherein the filter increases in size as the inflatable packer moves from the first position to the second position, and the filter comprises a first level of filter material configured to increase in surface area from the first position to the second position and a second level of filter material configured to increase in surface area from the first position to the second position.

12. The system of claim 11 further comprising a second port positioned a radial distance from the first port, the second port having a second filter at least partially covering the second port.

13. The system of claim 12 wherein the second filter of the second port is connected to the filter of the first port.

14. The system of claim 11 wherein the filter is secured to an outer layer of the packer.

15. The system of claim 11 wherein the filter material comprises a ball material with gaps between individual balls of the ball material, and further wherein the gaps are sized to receive fluid and prevent debris.

16. A method, comprising:

placing a packer in a downhole environment;

expanding the packer in the downhole environment so that an exterior surface of the packer contacts an interior diameter of the downhole environment, wherein during the expanding, a filter covering a drain in the packer expands from a first unexpanded position to a second expanded position, and the filter comprises a first level of filter material configured to increase in surface area from the first unexpanded position to the second expanded position and a second level of filter material configured to increase in surface area from the first unexpanded position to the second expanded position; and sampling the fluid through the filter.

17. The method of claim 16, wherein filter material comprises a bead material having gaps between the beads sized to receive fluid through the gaps.

18. The method of claim 17, wherein the filter expands by increasing in size.

19. The method of claim 17 wherein the filter expands by moving the first level of filter material with respect to the second level of filter material.

20. The method of claim 19, wherein the filter expands by the beads of the second level fitting within the gaps between the beads of the first level.

* * * * *